United States Patent [19]

Colclough et al.

[11] Patent Number: 5,052,617

[45] Date of Patent: Oct. 1, 1991

[54] ATOMIZATION OF LIQUIDS

[75] Inventors: Michael L. Colclough, Weybridge; Igan Hayati, Slough, both of England

[73] Assignee: Imperial Chemical Industries PLC, London, England

[21] Appl. No.: 433,781

[22] Filed: Nov. 8, 1989

[30] Foreign Application Priority Data

Nov. 10, 1988 [GB] United Kingdom ..... 8826357

[51] Int. Cl.[5] ..... B05B 17/04; B05B 5/02

[52] U.S. Cl. ..... 239/4; 239/3; 239/102.1; 239/690; 239/695

[58] Field of Search ..... 239/3, 4, 102.1, 690, 239/690.1, 695, 102.2, 699

[56] References Cited

U.S. PATENT DOCUMENTS

| | | | |
|---|---|---|---|
| 2,733,171 | 1/1956 | Ransburg | 239/3 |
| 3,123,305 | 3/1964 | Eisenkraft | 239/102.1 |
| 3,700,170 | 10/1972 | Blanka et al. | 239/102.1 |
| 3,941,312 | 3/1976 | Ohno et al. | 239/102.1 |
| 4,095,962 | 6/1978 | Richards | 239/3 |
| 4,381,533 | 4/1983 | Coffee | 239/690 |
| 4,659,012 | 4/1987 | Coffee | 239/690 |
| 4,776,515 | 10/1988 | Michalchik | 239/3 |
| 4,788,016 | 11/1988 | Colclough et al. | 239/690 |

*Primary Examiner*—Andres Kashnikow
*Assistant Examiner*—Christopher G. Trainor
*Attorney, Agent, or Firm*—Cushman, Darby & Cushman

[57] ABSTRACT

A method of atomizing a polar liquid utilizes apparatus comprising a tube having an inlet for liquid and at least one aperture providing an outlet from the tube for the liquid and a field intensifying electrode disposed adjacent the aperture. The method comprises applying a potential difference between the polar liquid and the field intensifying electrode and feeding the liquid along the tube from the inlet to the aperture.

In carrying out the method, the tube is supported at a position remote from the aperture and the potential difference, flow rate and tube stiffness are so selected relatively to each other that the tube can be electrostatically maintained in vibration or gyration to cause atomized liquid particles to be thrown from the tube at the aperture.

14 Claims, 4 Drawing Sheets

Figure 3:
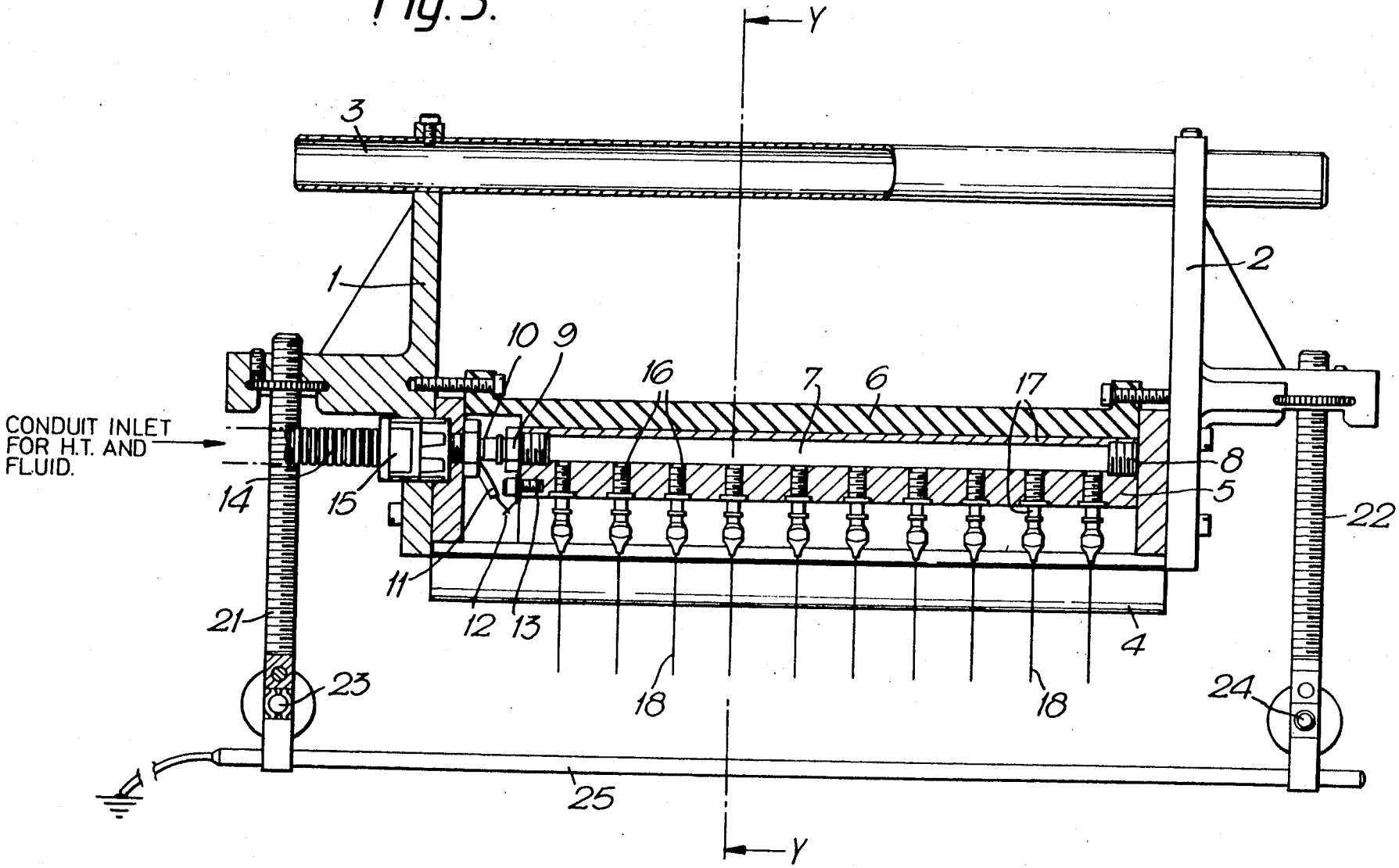

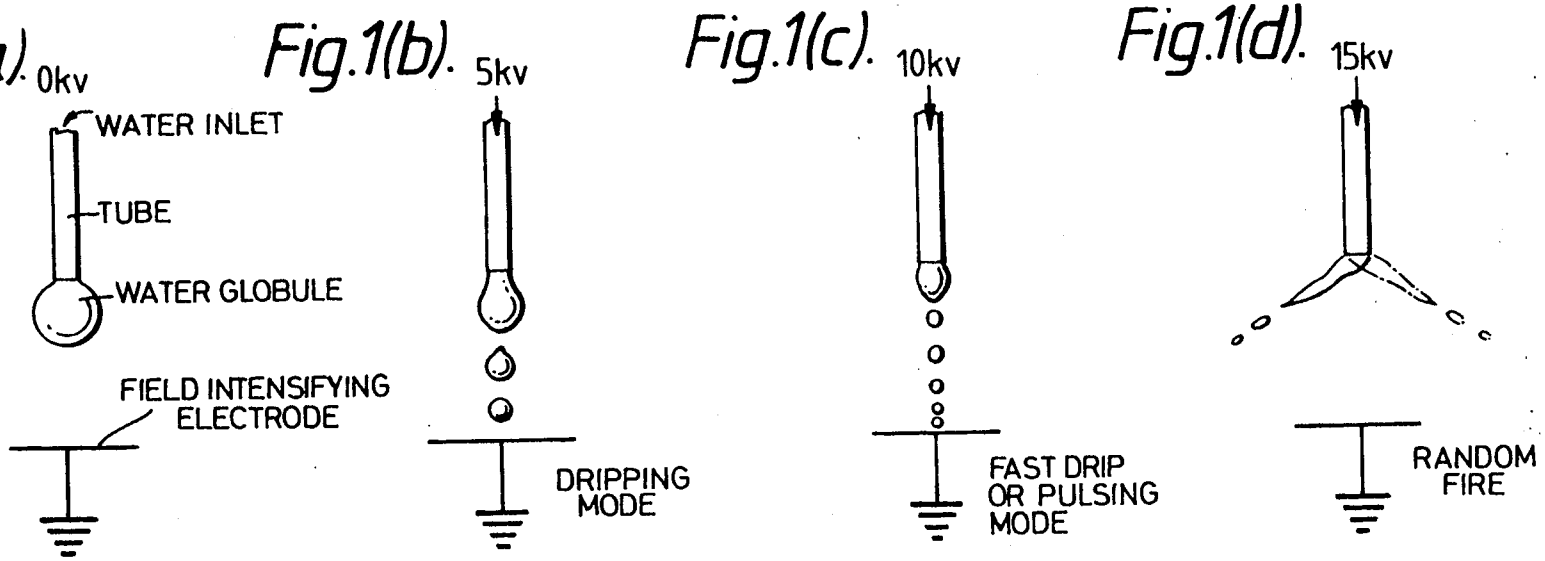
Fig.1(a).
0kv
WATER INLET
TUBE
WATER GLOBULE
FIELD INTENSIFYING ELECTRODE
Fig.1(b).
5kv
DRIPPING MODE
Fig.1(c).
10kv
FAST DRIP OR PULSING MODE
Fig.1(d).
15kv
RANDOM FIRE
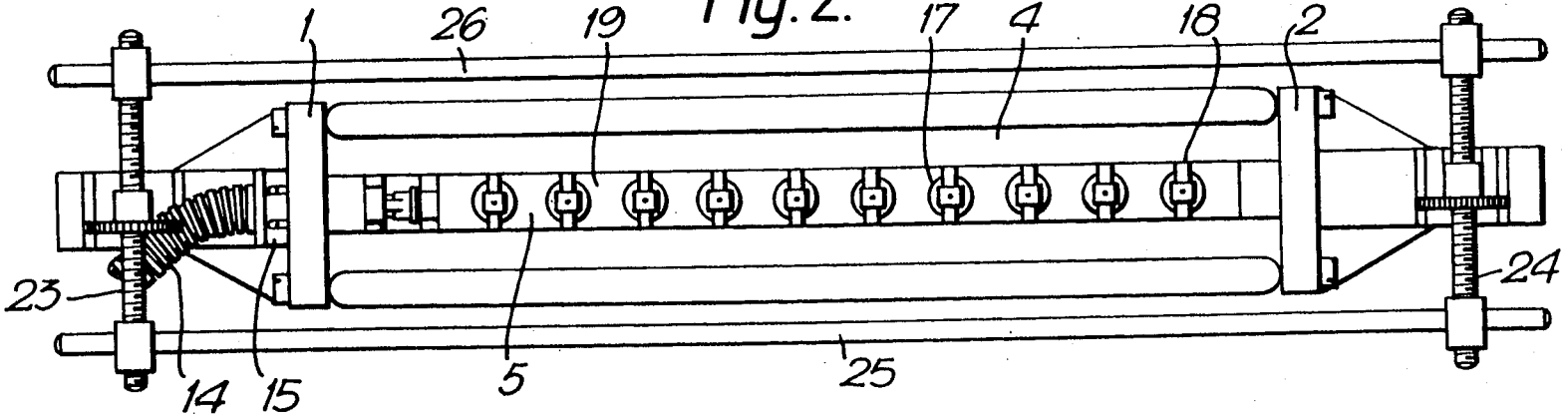
Fig. 2.
1
2
4
5
14
15
17
18
19
23
24
25
26

ATOMIZATION OF LIQUIDS

This invention relates to the atomisation of liquids utilising electrostatic forces.

In our British Patent Specification No. 1569707 there is disclosed an atomising process which comprises supplying a liquid to an electrically conducting or semi-conducting surface adjacent a field intensifying electrode and imposing a potential difference between the surface and the electrode, the electrode being at such a potential and so sited relative to the surface that an atomising field strength is created so that the liquid is atomised preponderantly by electrostatic forces to form electrically charged particles which are projected away from the electrode.

Such a process can be utilised for paint spraying or agricultural spraying.

In explaining this atomisation in British Patent Specification No. 1569707 it is stated that provided the liquids physical characteristics (e.g. resistivity, viscosity) and flow rate are such as to produce threads or ligaments (electrostatically) of liquid projecting about 1 cm. or more from the conducting surface, the atomisation will take place in that part of the field where the combined forces of inertia, gravity field and electrostatic field are directed away from the electrode. In practice it is found that atomised particles break away from the free end of the ligament. It is further stated in British Patent Specification No. 1569707 that how well a liquid is atomised depends, inter alia, on the nature of the liquid and then goes on to say that for practical purposes it had been found that highly polar liquids, such as water, do not atomise so well. Further investigations have shown that this is because a droplet forms on said surface, the droplet surface being a substantially equipotential surface so that a potential gradient is not present on the surface, this being a basic requirement for the formation of the ligament electrostatically.

In British Patent Specification No. 1569707 several configurations of said conducting surface are described and normally comprise at least the edge of an aperture in a conduit through which the liquid is fed. For example the conduit may comprise a metal capillary tube.

It is a serious drawback as regards practical applications that water and other polar liquids such as water-borne paints cannot be satisfactorily atomised utilising purely electrostatic forces in the manner described in British patent Specification No. 1569707 and it is the object of the present invention to overcome this problem.

According to one aspect of the invention, a method of atomising a polar liquid utilises apparatus comprising a tube having an inlet for the liquid and at least one aperture providing an outlet from said tube for the liquid, and a field intensifying electrode disposed adjacent said aperture, the method comprising applying a potential difference between said polar liquid and the field intensifying electrode and feeding the liquid along the tube from said inlet to said aperture;

the method being characterised in that the tube is supported at a position remote from said aperture, said potential difference, flow rate and the stiffness of the tube are so selected relatively to each other that the tube can be electrostatically maintained in vibration or gyration to cause atomised liquid particles to be thrown from said tube at said aperture.

According to another aspect of the invention there is provided an apparatus for atomising a polar liquid comprising a tube having an inlet for liquid at one end and an outlet aperture for liquid at its other end, a field intensifying electrode disposed adjacent said aperture, a power supply means for applying a potential difference between the liquid in the tube at said aperture and the field intensifying electrode and liquid supply means for feeding liquid through the tube at a predetermined flow rate;

characterised in that the tube is fixedly supported at a position remote from said aperture and the tube stiffness is less than 60 N/m.

The invention is based on the surprising discovery that for a polar liquid such as water, if the potential difference between the polar liquid and the field intensifying electrode is sufficiently high (assuming a typical practical distance of say 2 cm. laterally between the outlet aperture and the field intensifying electrode) and the stiffness of the tube and flow rate in relation to this potential difference is within a certain range the electrostatic forces will set and maintain the tube in vibration or gyration. Tests have shown that once the tube has been set into vibration or gyration the critical voltage, i.e. potential difference with respect to earth, below which vibration cannot be maintained for different stiffnesses and flow rates is given by the following empirical linear equation expressed in dimensionless form:

$$\log_e Q\sqrt{\frac{\rho}{Sd^3}} = -1 - 1.3\log_e\left(\frac{Vd}{Q}\right)\sqrt{\frac{\epsilon_o}{\rho}} \quad (1)$$

where V = critical voltage (volts)

Q = flow rate (meters$^3$/sec)

$\rho$ = density of liquid (kilograms/meter$^3$)

S = stiffness (Newtons/meter)

d = tube diameter (meters)

$\epsilon_C$ = permittivity of free space ($8.85\times10^{-12}$) coulombs$^2\times$Newtons$^{-1}\times$meters$^{-2}$)

The various changes that can occur with a polar liquid, such as water, flowing in a tube upon increase of potential difference is illustrated diagrammatically in the accompanying FIG. 1. Referring to FIG. 1 the condition at (a) is that there is no potential difference between the tube (which is a capillary tube) and the field intensifying electrode. In this condition water globules form on the end of the tube and drop off periodically when, they reach a certain size. At (b) where the potential difference is say 5 kV the water starts to drip at a faster rate and smaller droplet size. At (c) the potential difference is increased to say 10 kV and the charge on the tip of the globule becomes sufficiently high to emit a stream of small droplets in a pulsating mode.

At (d), where the potential difference has been increased to say 15kV, the water globule is continuously distorted in different directions as shown, due to the radial forces acting on the globule. Depending on the rate of flow and the stiffness of the tube, this will cause the tube to vibrate or gyrate.

In the case of vibration the distortion of the water-globule causes a random firing of charged water particles from the distorted globule in random directions and these charged water particles as they are fired off provide an electrostatic repulsion force which has a lateral component to flex the tube. It is when the pulsation rate of these droplets approaches the natural frequency of the tube that the latter is set into vibration. The repulsion forces between charged particles thrown off as a result of the vibration and the water globule maintain the vibration.

At low water flow rates once the tube is vibrating atomised particles are thrown off from the aperture. In the case of higher flow rates instead of charged water particles being thrown off from the aperture a projection of liquid extends laterally from the aperture in the form of a ligament and charged particles are thrown off the ligament as the tube vibrates. Excessively high flow rates suppress the mechanical vibration and hence limit atomisation.

Considering the vibration or gyration the tube the period of oscillation is given by:

$$T = 1.787\, L^2 \sqrt{\frac{M}{EI}} \qquad (2)$$

where M=the mass of the tube per unit length including the liquid in the tube (kg/m)

E=Young's modulus ($N/m^2$)

I=The second moment of inertia ($m^4$)

L=Length of tube (m)

The vibration frequency is given by:

$$f = \frac{1}{T}\ (Hz) \qquad (3)$$

Since the vibration frequency is dependent on the physical properties of the tube and the mass of liquid in the tube, for a given tube the atomisation characteristics of a given liquid can be controlled to a large extent by controlling the vibration amplitude.

The amplitude of vibration is very dependent upon the bending stiffness of the tube. The bending stiffness of the tube can be defined as:

$$\text{Stiffness} = \frac{\text{Load}}{\text{Displacement}} = \frac{3EI}{L^3}\ (N/M) \qquad (4)$$

Theoretically, once the tube has been set into vibration then the properties of the liquid itself such as electrical conductivity, flow-rate, viscosity and surface tension should not unduly influence the ability of the tube to vibrate. However they do influence amplitude and ligament break up and hence alter the atomisation characteristics which will consequently vary from one liquid to another.

The potential difference which can be applied will be limited by corona discharge and sparking.

In experimental work carried out so far it has been found that for a given flow rate the tube will vibrate (i.e. oscillate in one plane) if it is within certain limits of stiffness above say 20 N/m, and will tend to gyrate if it is within a certain lower limit below this stiffness and the flow rate is higher. For example with an applied voltage of 15 KV a flow rate of 1 to 5 cc/min. and a stiffness from about 20 N/m up to about 60 N/m the tube will vibrate. With the same applied voltage, a flow rate of say 10 cc and a stiffness about 20 N/m or below the tube will gyrate. As in the case of vibration, the gyration is maintained by the repulsion forces between the droplets emitted from the globule (which at the higher flow rate is of ligament form) and the tube. At lower stiffnesses still the tube can vibrate at a harmonic frequency. All of these modes can be utilised in the present invention. The phenomenon also occurs irrespective of whether the tube is horizontal or vertical with the outlet directed upwards or downwards.

If the liquid passing through the tube is not sufficiently polar for it to be atomised by the vibrating or gyratory method of the invention, then it will still be atomised by the method described in our British Patent specification No. 1569707, in which a ligament is produced by the potential gradient and atomised liquid particles break away from the free end of the ligament.

Figure 4:
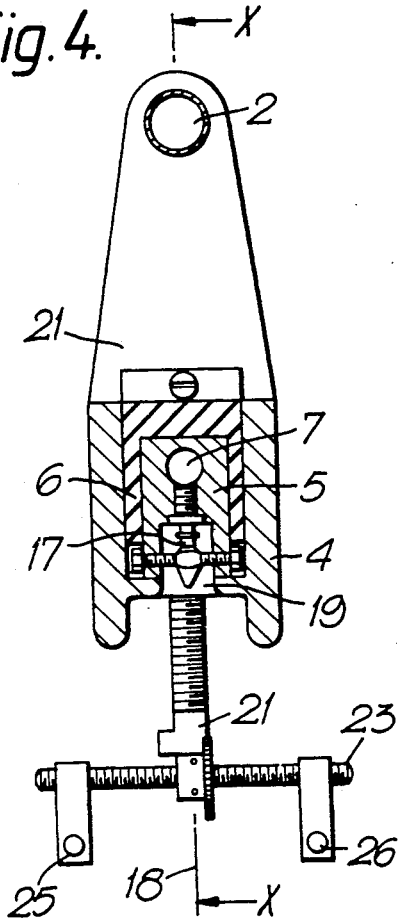
Figure 5:
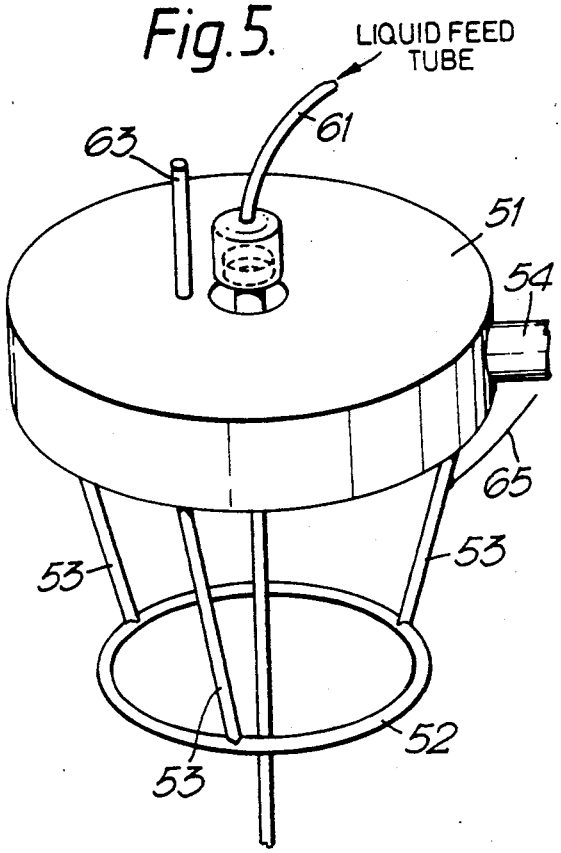
Figure 6:
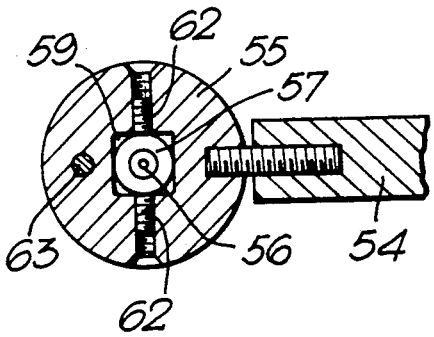
Figure 7:
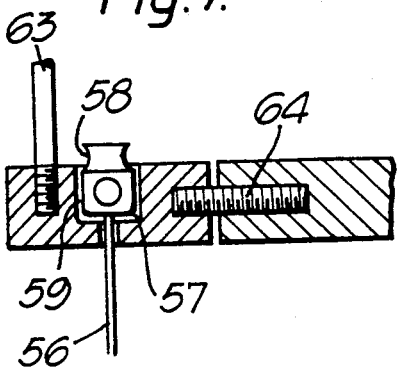

Embodiments of the invention will now be further described by way of example with reference to FIGS. 2 to 7 of the accompanying drawings, in which:

FIG. 2 shows an elevational view of the apparatus for carrying the invention into effect in accordance with a first embodiment, FIG. 3 shows a sectional view of the apparatus on the line X X of FIG. 4, FIG. 4 shows a sectional view of the apparatus on the line Y Y of FIG. 3, FIG. 5 shows a perspective view of the apparatus for carrying the invention into effect in accordance with a second embodiment, FIGS. 6 and 7 show detail sectional views of the apparatus of FIG. 5, and FIGS. 8 to 10 show diagrammatical modifications of the needle form tube used.

Referring now to FIGS. 2 to 4, the apparatus comprises a portable electrostatic spray gun having a support comprising two end brackets 1 and 2 and a carrying handle 3 extending between the brackets 1 and 2.

The spray gun itself comprises an elongated main body 4 of insulating material which is secured to the two end brackets 1 and 2. The main body 4 is of substantially U-section (as best seen in FIG. 4) and houses a high tension/liquid section 5 of electrically conducting material and which is surrounded on three sides by a high tension shroud 6 of insulating material.

A bore 7 extends through the section 5 and is closed off at one end by a plug 8 (FIG. 3). At its other end a connector 9 connects the bore 7 with a flexible tube 10 for feeding liquid into the bore 7. A high tension lead 11 is soldered to a tag 12 which is secured in electrical contact with the section 5 by a bolt 13. Both the liquid feed tube 10 and the lead 11 pass into a flexible conduit 14 which is secured into the end bracket 1 by a connector 15. The conduit 14 leads to a liquid reservoir and also to a source of high tension (not shown).

A row of ten threaded transverse bores 16 extend from the bore 7 to the lower face (as seen in FIGS. 3 and 4) of the section 5. Into each bore 16 is screwed a nipple type connector 17 and into each nipple 17 is clamped a hollow needle 18, such as is used for hypodermic needles, and which in effect are capillary tubes for liquid received from the bore 7 through the transverse bores 16. The nipples 17 and needles 18 project downwardly through a slot 19 (FIG. 4) in the main body 4. Since the needles 18 are electrically connected through metallic components to the high tension lead 11 a high potential can be imposed on them.

Extending downwardly (as seen in the drawings) from the end brackets 1 and 2 are two legs 21 and 22. At the lower end of each of these legs is a cross-bar 23,24. From the ends of these cross-bars 23 and 24 are supported two electrically conducting rods 25 and 26 which extend on either side of the row of needles 18 and are encased in a semi-insulator. These two rods 25 and 26 constitute field intensifying electrodes and are normally at an intermediate potential between the needles and earth potential.

In operation of the spray gun the liquid is fed from the reservoir at a controlled rate and the section 5 is connected to the high tension source so that the needles 18 are at a high potential. The stiffness of the needles 18 is such that under the imposed conditions of potential and flow rate they are set in vibration in the manner described above. This causes sprays of atomised particles to be produced by each needle.

Referring now to FIGS. 5 to 7, the apparatus of the second embodiment which is somewhat simpler than the first embodiment, comprises a plastics housing 51 from which an annular field intensifying electrode 52 is suspended by supporting rods 53. The apparatus has an insulating handle 54.

Within the housing 51 is a brass holder 55 for the tubular needle 56. The needle 56 is firmly secured in a head 57 which has an integral connector 58 for connecting a tube 61 for supplying liquid to the needle 56. The head 57 is located with a close fit in a recess 59 in the holder 55 and is symmetrically clamped in the recess by two opposing grub screws 62. The holder 55 has a terminal pin 63 screwed into it to provide a high voltage connection to the holder 55. The handle 54 which is of insulating material is secured to the holder 55 by threaded pin 64. The field intensifying electrode is connected to an intermediate voltage via one of the supporting rods 53 and lead 65.

In operation, having connected the terminal pin 63 to a high voltage source, liquid is fed from a reservoir to the needle 56 at a controlled rate. The stiffness of the needle 56 is so selected that under the existing high voltage and flow rate the needle is set into gyration as described above to produce cone-shaped sprays of atomised liquid.

If desired several of the units shown in FIGS. 5 to 7 could be assembled together to form a battery.

As alternatives to using the form of hollow needles described above the following modifications can be effected either singly or in combination as appropriate.

Figure 8:
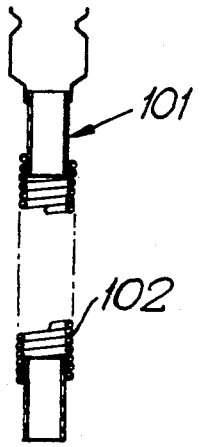

Referring to FIG. 8 a hollow needle 101 is shown which includes a spring section 102 that flexes laterally to provide the needle with an effective low stiffness and so allow more scope for the design of the needle itself. For example the spring section 102 in the form of a coiled tension spring can be selected to provide a certain stiffness. The needle as a whole can then be made of larger diameter and shorter length than a needle as described above and having the same stiffness. Hence the pressure drop along the needle can be less for a given flow rate.

Figure 9:
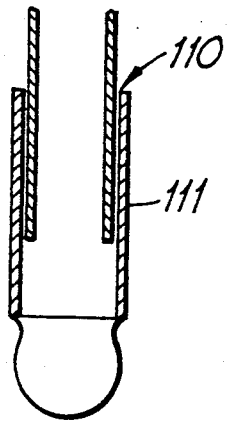

Referring to FIG. 9 the needle 110 has a sleeve 111 on the bottom which defines the aperture and which is of larger diameter than the tube in order to decrease the velocity at which the liquid exits from the needle. Hence higher flow rates which could dampen vibration or gyration in the manner described above can be used. The sleeve 111 also adds load to reduce stiffness.

Figure 10:
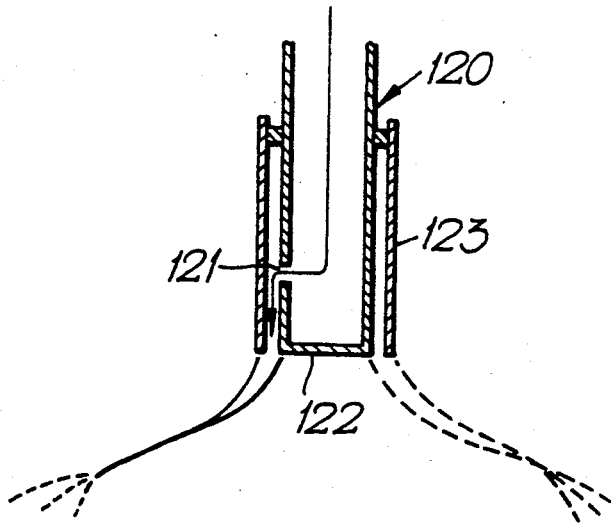

Referring to FIG. 10 instead of the water flow having its liquid outlet in the tip of the needle 120, outlet 121 is provided in the side and the tip blocked off as shown at 122. This causes the liquid to exit eccentrically of the needle axis. After exiting through outlet 121, the liquid is guided towards the tip of the needle 120 by a surrounding sleeve 123 supported by the needle. The eccentric exiting of the liquid will assist in the gyration mode. Also the sleeve 123 adds weight i.e. load to the needle and will therefore reduce the stiffness of the needle.

What is claimed is:

1. A method of atomising a polar liquid utilising apparatus comprising a tube having a predetermined stiffness and having an inlet for liquid and at least one aperture providing an outlet from the tube for the liquid, mounting means whereby the tube is fixedly supported at a position remote from the aperture, a field intensifying electrode disposed adjacent said aperture, means for feeding the polar liquid to said inlet so that it flows through the tube to the aperture, and means for applying a potential difference between the liquid and the field intensifying electrode, the method comprising applying the potential difference and feeding the liquid through said tube, the potential difference and the flow rate being so related to each other and to the stiffness of the tube that the tube is maintained electrostatically in vibration or gyration to cause atomised liquid particles to be thrown from said tube at said aperture.

2. A method according to claim 1, wherein the flow rate is sufficiently high that a liquid projection extends from said aperture in the form of a ligament and the atomised liquid particles are thrown from the liquid projection.

3. A method according to claim 1, wherein the stiffness of the tube is less than about 60 N/m.

4. A method according to claim 3, wherein the stiffness of the tube is between about 20 N/m and about 60 N/m.

5. A method according to claim 3, wherein the applied potential with respect to earth is about 15 KV, and the flow rate through the tube is between 1 and 10 cc. per minute.

6. A method according to claim 1, wherein the liquid exits from said tube at a lateral aperture in the tube.

7. A method according to claim 1, wherein the flow velocity is decreased adjacent said aperture.

8. An apparatus for atomising a polar liquid comprising a tube having a stiffness less than 60 N/m and having an inlet for liquid at one end and an outlet aperture for liquid at its other end, mounting means whereby the tube is fixedly supported at a position remote from said aperture, a field intensifying electrode disposed adjacent said aperture, means for feeding a liquid to said inlet so that it flows through the tube to the aperture at a predetermined flow rate and means for applying a predetermined potential difference between the liquid at the aperture and the field intensifying electrode, such that the tube is maintained electrostatically in vibration to cause atomised liquid particles to be thrown from said tube at said aperture.

9. An apparatus according to claim 8, wherein said power supply means is capable of providing a voltage output of at least 15 KV.

10. An apparatus according to claim 8, wherein the outlet aperture in said tube is at its tip.

11. An apparatus according to claim 8, wherein the outlet aperture is a lateral outlet.

12. An apparatus according to claim 11, wherein the tube is surrounded by a sleeve at said aperture to guide the liquid to the tip of the tube.

13. An apparatus according to claim 8, wherein the tube has a coiled spring section forming part of its length whereby to provide the tube with said stiffness.

14. An apparatus according to claim 8, wherein the tube has a sleeve which defines said aperture and which is of larger diameter than the rest of the tube in order to decrease the exit velocity of the liquid from the tube as compared with its velocity through the rest of the tube.

* * * * *